US007828181B1

(12) United States Patent
Reitano

(10) Patent No.: US 7,828,181 B1
(45) Date of Patent: Nov. 9, 2010

(54) UNIVERSAL PILL SPLITTER AND METHOD OF USE

(76) Inventor: Carmen Reitano, 2 Littlefield Ct., Haverhill, MA (US) 01832

( * ) Notice: Subject to any disclaimer, the term of this patent is extended or adjusted under 35 U.S.C. 154(b) by 134 days.

(21) Appl. No.: 12/400,652

(22) Filed: Mar. 9, 2009

Related U.S. Application Data

(63) Continuation of application No. 11/761,106, filed on Jun. 11, 2007, now abandoned.

(51) Int. Cl.
*B26F 3/00* (2006.01)

(52) U.S. Cl. ..... 225/1; 225/105; 269/901; 29/283.5

(58) Field of Classification Search ..... 225/1, 225/103–105; 269/901; 29/281.1, 283.5
See application file for complete search history.

(56) References Cited

U.S. PATENT DOCUMENTS 4,173,826 A * 11/1979 Leopoldi et al. ..... 30/124
4,199,863 A * 4/1980 Deckert ..... 30/124
4,887,755 A * 12/1989 Gibilisco ..... 225/103
5,118,021 A * 6/1992 Fiocchi ..... 225/103
6,050,064 A * 4/2000 Yuyama et al. ..... 53/514
6,601,746 B2 * 8/2003 Buckley et al. ..... 225/103
7,243,826 B2 * 7/2007 Darst ..... 225/103
7,252,254 B1 * 8/2007 Engel et al. ..... 241/168
2003/0019900 A1 * 1/2003 Dienst ..... 225/104
2003/0084574 A1 * 5/2003 Eric ..... 30/124
2005/0067452 A1 * 3/2005 Darst ..... 225/103
2007/0164141 A1 * 7/2007 Engel et al. ..... 241/169.2
2008/0011803 A1 * 1/2008 Petrie et al. ..... 225/103
2009/0183373 A1 * 7/2009 Suhr ..... 30/124

* cited by examiner

*Primary Examiner*—Kenneth E. Peterson
*Assistant Examiner*—Sean Michalski
(74) *Attorney, Agent, or Firm*—Mark P. White

(57) ABSTRACT

A universal pill splitter as an upper pill splitter body with a cutting blade affixed to a lower side of the upper body and a lower body rotating affixed to the upper body, with two pill stops affixed to the upper side of the lower body, with a slide slidingly affixing to the lower body, wherein the slide further contains two pill guides at either side of a slot centrally located in the slide body, so that when a pill is place on the lower body against the pill stops and the slide is pushed forward so that it engages the pill, pressing it securely against the pill stops, the pill may be split by rotating the upper body toward the lower body, thereby driving the cutting blade against a top of the pill.

8 Claims, 9 Drawing Sheets

UNIVERSAL PILL SPLITTER AND METHOD OF USE

This application claims priority based on U.S. application Ser. No. 11/761,106, filed on Jun. 11, 2007.

Pill splitters have become increasingly popular at the present time because of the constantly increasing cost of prescription drugs, and the inability of many users to obtain insurance which pays for much or all of their medication.

Many medications are marketed and priced in a variety of sizes in which the prices do not vary proportionately to the dosage. In such cases it is financially advantageous for a user to buy high dosage pills and split them into lower, prescribed dosages. Thus, pill splitting has become a preferred method for many drug users to make their medications more affordable.

Existing pill splitters have presented a number of problems, however. A typical problem is presented by the myriad of different shapes in which modern medications are manufactured. Existing pill splitters have attempted to deal with this problem by designing pill splitter with a number of different pill beds which must be inserted into the pill splitter for each different pill shape.

The present device provides a pill splitter effective for splitting a number of pills which have different, complex shapes, but unlike existing pill splitters, however, the present pill splitter does not require a different, interchangeable bed for each different shape of pill, but allows a wide variety of pills to be split in the same splitter.

A further problem with many pill splitters is that they do notaccurately split a pill in equal parts, resulting in unequal and inaccurately calculated dosages. The present device solves this second problem as well, providing cleanly and accurately split pills.

Finally, some of the existing pill splitters required the user to strike the cap of the splitter with the palm of the hand, which has been found to be uncomfortable for some users, especially older users. The present device, in contrast, is easy to use, and does not present the possibility of trauma to the user.

The present device traverses the need for separate pill beds by providing a unique centering and alignment mechanism, which allows pills of varying sizes and shapes to securely maintained in position within the pill splitter, so that precise and reproducible splitting of the pill is accomplished.

Furthermore, the lever arm mechanism provides ease of operation, as compared to the plunger type pill splitters.

The design of the present pill splitter provides an extremely compact unit, which can easily and safely be carried in a pocket or purse, without the sharp or extending parts which make competing units found in previous pill splitters uncomfortable or awkward to carry. It also contains a pill box within the body of the device, which provides additional convenience to the user.

SUMMARY OF THE DEVICE

It is a feature of the present device to provide a pill splitter which will split pills of various sizes and shapes into halves or quarters. It is a further feature of this device to provide such a pill splitter which does not require a pill bed corresponding to the shape of the pill.

In accordance with one aspect of the present device, a universal pill splitter includes an upper body, a cutting blade affixed to a lower side of the upper body, and a lower body, rotatingly affixed to the upper body.

In accordance with a second aspect of the Device, one or more pill stops are affixed to the upper side of the lower body.

In accordance with a third aspect of the device a slide is slidingly affixed to the lower body by means of one or more pill guides.

In accordance with a fourth aspect of the device, when a pill is placed with one edge against the pill stops, and the slide is advanced toward the pill stops until the pill guides firmly retain the pill between the pill stops and the pill guides, the pill may be split by rotating the upper body downward, thereby engaging the cutting blade against a top of the pill.

In accordance with a fifth aspect of the device the slide has an upper edge and a lower edge, the upper edge comprising the pill guides.

In accordance with a sixth aspect of the device a slot is formed in the slide substantially perpendicular to the forward edge.

In accordance with a seventh aspect of the device the pill guides are affixed to an upper side of the slide, with one on either side of the slot.

In accordance with an eighth aspect of the device the pill guides are cylindrical in form.

In accordance with a ninth aspect of the device the pill guides extend beyond the forward edge of the slide.

In accordance with a tenth aspect of the device the slide further comprises a handle on the rear edge.

In accordance with an eleventh aspect of the device the pill stops comprise a left stop and a right stop, the two stops having a space between them.

In accordance with a twelfth aspect of the device the two stops forming a "V" shape with the open end of the "V" facing the rear edge of the slide.

In accordance with a thirteenth aspect of the device, the device includes the step of placing a pill on the lower body against the pill stops.

In accordance with a fourteenth aspect of the device, the device includes the step of sliding the slide toward the pill until the pill guides engage the pill, pressing it firmly against the pill stops.

In accordance with a fifteenth aspect of the device the device includes the step of rotating the upper body toward the lower body, thereby driving the cutting blade against a top of the pill and splitting it in half.

In accordance with a sixteenth aspect of the device the device includes the step of withdrawing the slide away from the pill just split.

In accordance with a seventeenth aspect of the device the device includes the step of removing one half of the split pill, and rotating the other half so that the straight edge of the pill where the cutting blade split the pill in half is disposed toward the slide, and the other side of the pill rests against the pill stops.

In accordance with an eighteenth aspect of the device the device includes the step of pushing the slide toward the pill half until said pill half is securely retained between the pill guides and the pill stops.

In accordance with a twentieth aspect of the device the device includes the step of rotating the upper body toward the lower body, thereby driving the cutting blade against a top of the pill half, and splitting it into fourths.

BRIEF DESCRIPTION OF THE DRAWINGS

These, and further features of the device, may be better understood with reference to the accompanying specification and drawings depicting the preferred embodiments, in which.

DESCRIPTION OF THE PREFERRED EMBODIMENTS

Figure 1:
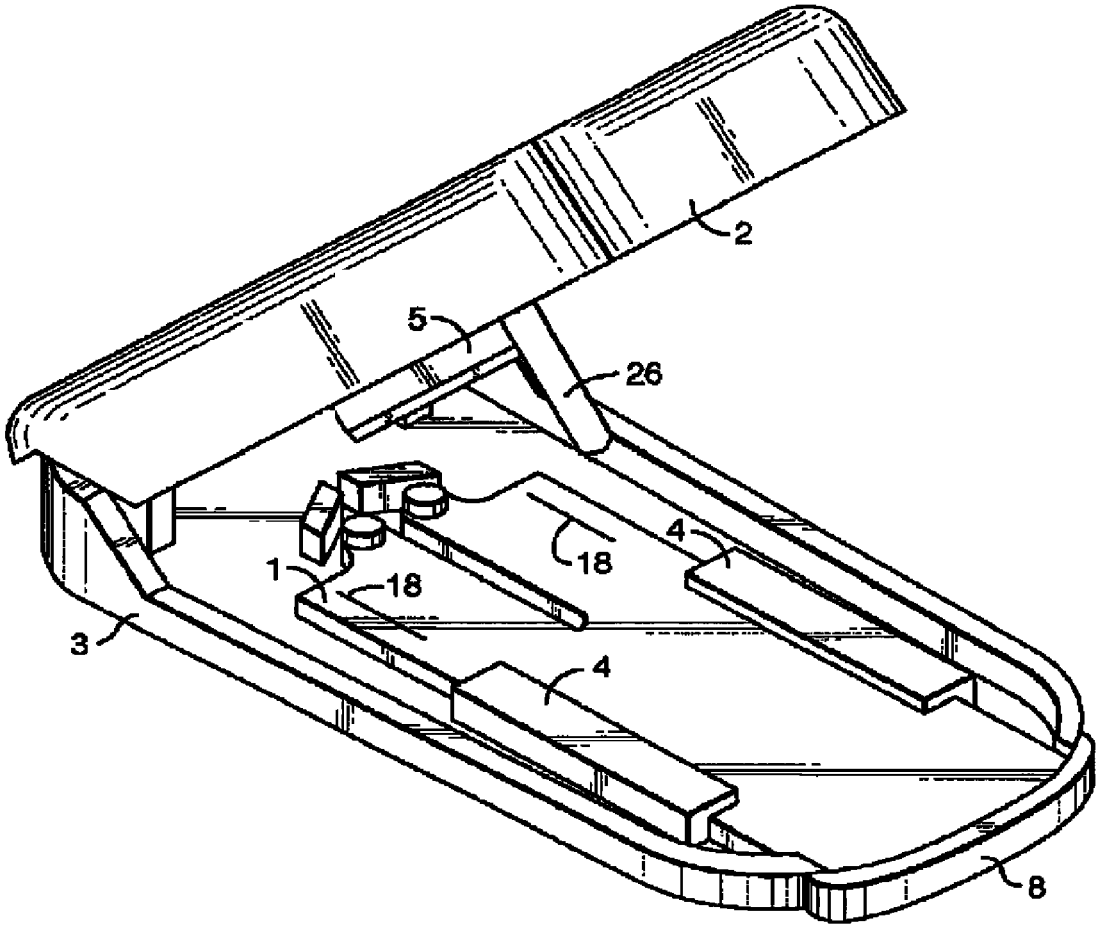
FIG. 1 depicts a perspective view of the pill splitter, with the upper body rotated into the open position, and with the slide displayed.
Figure 3:
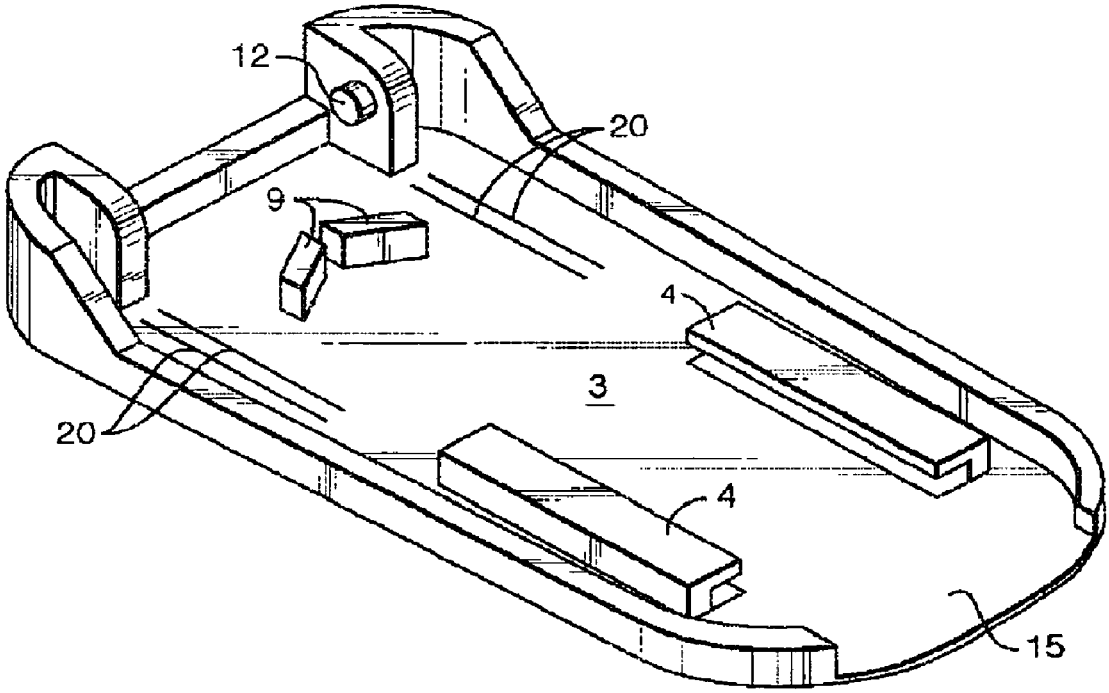
FIG. 3 depicts a perspective view of the lower body of the pill splitter, with the slide removed.
Figure 9A:
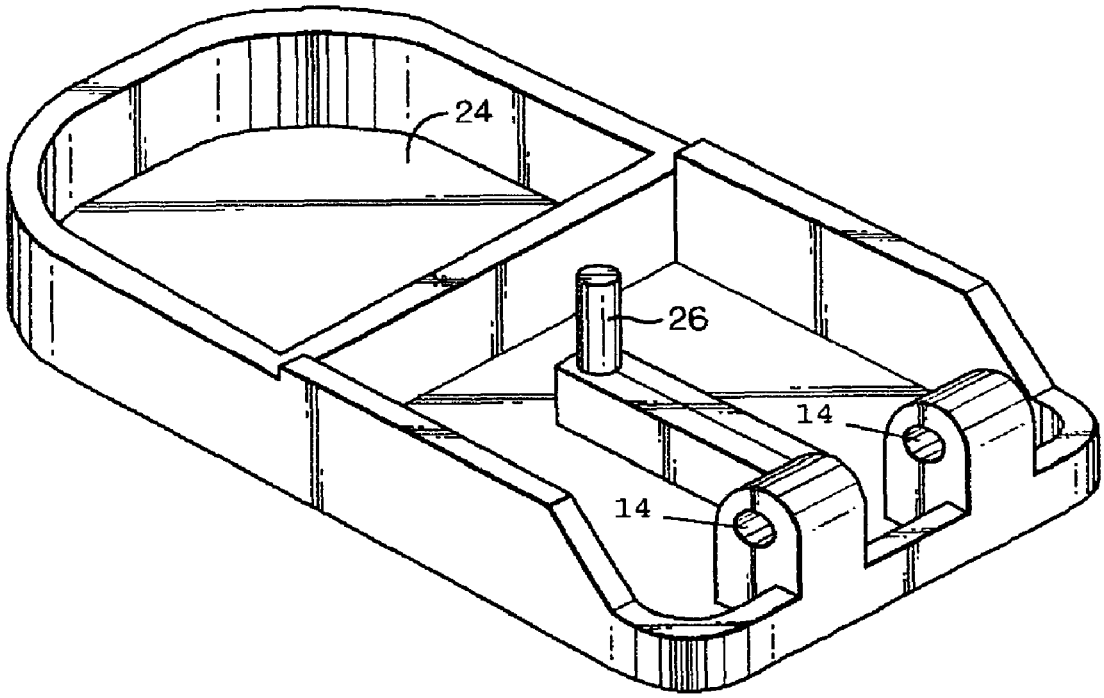
FIG. 9A depicts a perspective view of the upper body of the pill splitter, with the finger guard shown.

The universal pill splitter may be understood by first referring to FIG. 1, which depicts a perspective view of the device, whose main components are the upper body 2 and lower body 3, joined together by a rotatable joint which allows the upper body to rotate toward and away from the lower body. In the preferred embodiment this joint is a simple axle 12 as seen in FIG. 3, which mates with a hole in a plate 14 affixed to the upper body, as seen in FIG. 9A. In other embodiments, it may be a more complicated hinge.

The lower body 3 contains a slide 1, which is retained more or less parallel to the outer sides of the lower body by means of slide guides 4. The slide also contains alignment rulings 18, which are used as an aid to aligning large pills within the mechanism. Alignment of the pills is further discussed infra.

The details of the lower body may be viewed by next referring to FIG. 3. The slide guides are seen to have an L-shaped cross section, so that the slide is constrained to move in close proximity to the top surface of the lower body, and further cannot swivel or yaw as it move forward and backward on the lower body. The axles 12, one of which may be seen in this drawing, are affixed at the forward end of the lower body, and mate with axle holes in the upper body, allowing the upper body to swivel relative to the lower body. Also seen in this figure are the pill stops 9, which consist of two bars having rectangular cross sections, and having the shape of the letter "V" when viewed from above, with the open end of the "V" facing toward the slide and slide guides.

Figure 2:
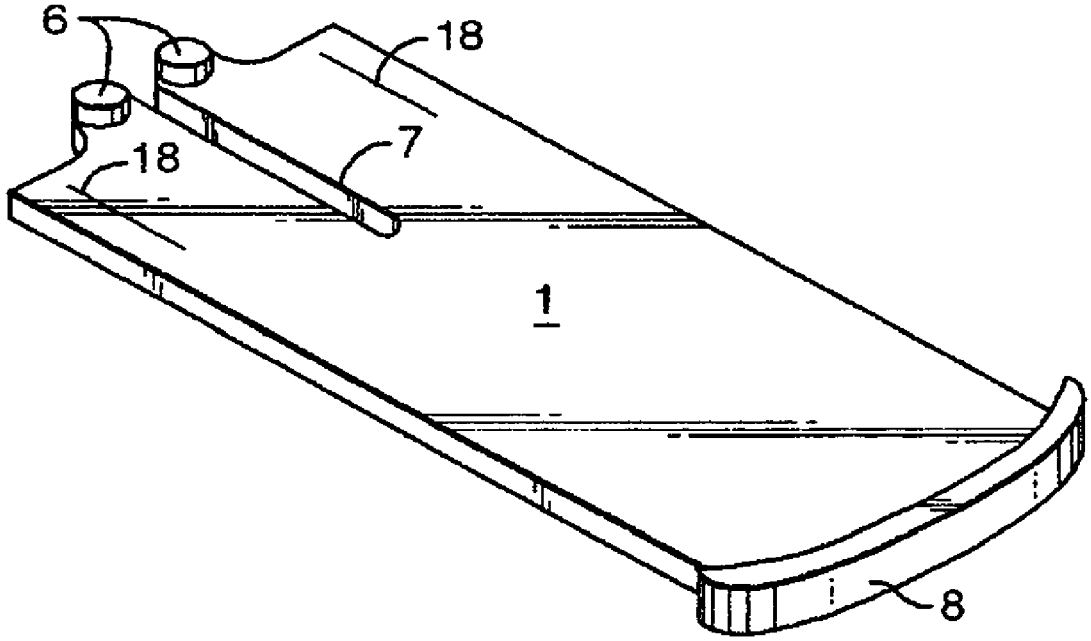
FIG. 2 depicts a perspective view of the slide.

The slide 1 itself is depicted in FIG. 2. The slide has a thin, flat main body whose forward end contains the two pill guides 6, each disposed on opposing sides of the slot 7. The slide alignment rulings 18 are used to assist the user in aligning pills of unusual sizes or shapes.

The slot 7 aligns with the cutting blade when the upper body is rotated toward the lower body, so that the cutting blade does not actually come into contact with the slide, but descends into the slot.

The slot is further aligned with the finger guard 26 shown in FIG. 1, which is further discussed in the following paragraphs.

The pill guides themselves are formed from both the two cylindrical pieces, permanently affixed to the forward end of the slide, and the two projections of the slide, directly below the cylindrical pieces, and which have the same circular shape, formed at the forward end of the slide. The extension of these pill guides beyond the forward edge of the slide provides clearance between the forward end of the slide and the pill stops 9 when small pills are split. This configuration allows for the secure disposition within the pill guides of a small pill of circular cross section, as may be understood by referring next to FIGS. 7 and 8.

Figure 8:
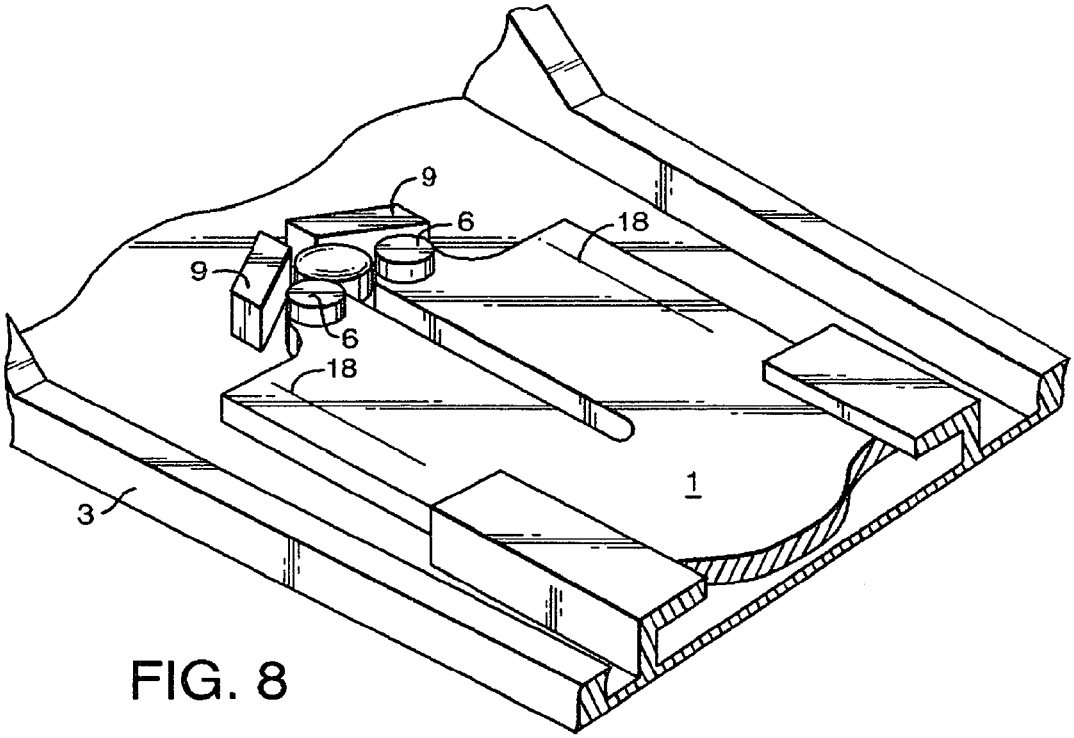
FIG. 8 depicts a perspective view of the portion of the lower body of the pill splitter in proximity to the upper stops, with the pill of FIG. 7 securely retained between the upper stops and the pill guides.

Referring next to FIG. 8, it is seen that the slide can be pushed forward, until the pill is pressed against the pill stops 9, because of the forward projection of the pill guides. If the pill guides did not project forward of the front edge of the slide, the slide would contact the pill stops before the pill was held securely in place by the pill guides.

The slide also contains a handle 8, which mates with a recess 15 in the rear edge of the lower body when the slide is pushed all the way forward. The handle provides ease of handling when pushing the slide in or retracting it.

Figure 4:
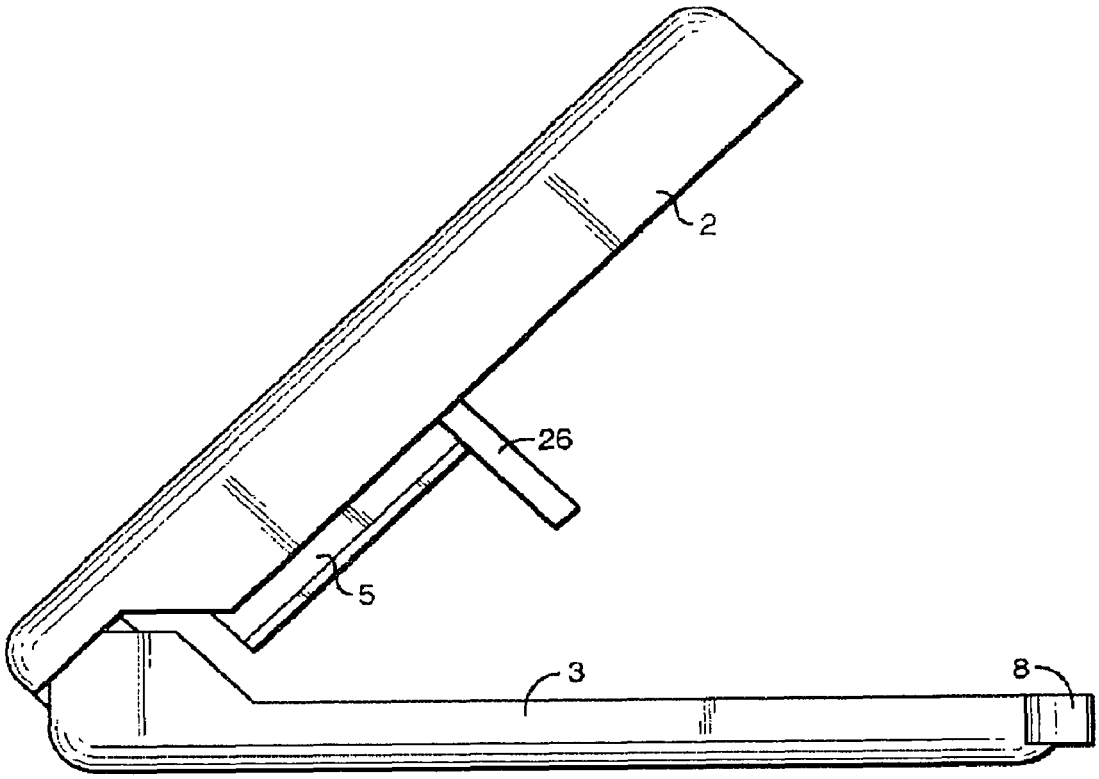
FIG. 4 depicts a side elevation view of the pill splitter, with the upper body rotated into the open position.

Referring next to FIG. 4, a side elevation view of the pill splitter shows the relative position of the blade 5 and the upper and lower bodies of the pill splitter. The blade is seen to extend below the lower surface of the upper body, so that it will approximately reach the upper surface of the lower body when the pill splitter is in "closed" position. That is, when the upper body has been closed over the lower body, so the two are in contact over the entire periphery of the two bodies.

Figure 9B:
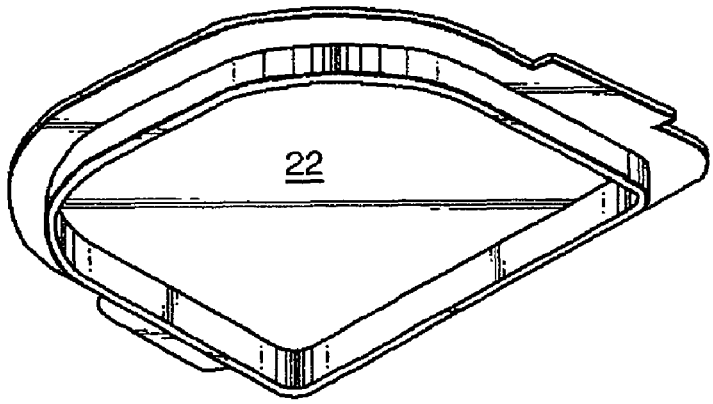
FIG. 9B depicts the cover of the pill box, which mates with the upper body of the pill splitter.
Figure 10:
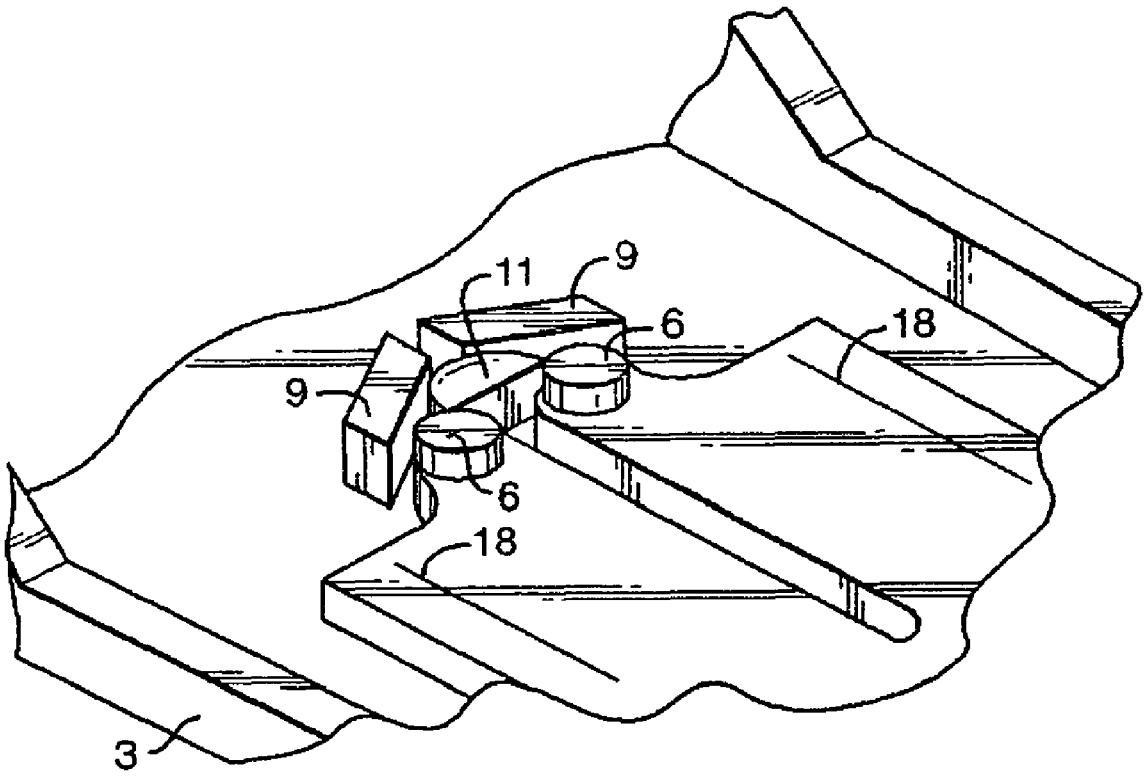
FIG. 10 depicts a perspective view of the pill splitter of the portion of the lower body of the pill splitter in proximity to the upper stops, with a pill half securely retained between the upper stops and the pill guides

Also shown in FIG. 4 is the finger guard 26 disposed at the rear end of the blade. This finger guard prevents the user from inserting his finger below the blade as the pill splitter is being closed. The finger guard is also shown in FIG. 9A, which shows the upper body in inverted perspective view. This figure further demonstrates how the forward end 24 of the upper body forms a pill container, or pill box, which is closed off by means of the pill container top 22, which is shown in FIG. 9B in perspective view. The pill container top is simply press fit into the pill box 24 in the preferred embodiments. Other means of affixing, opening and closing the pill container top, such as hinges, are possible, and provided for in alternative embodiments.

Figure 7:
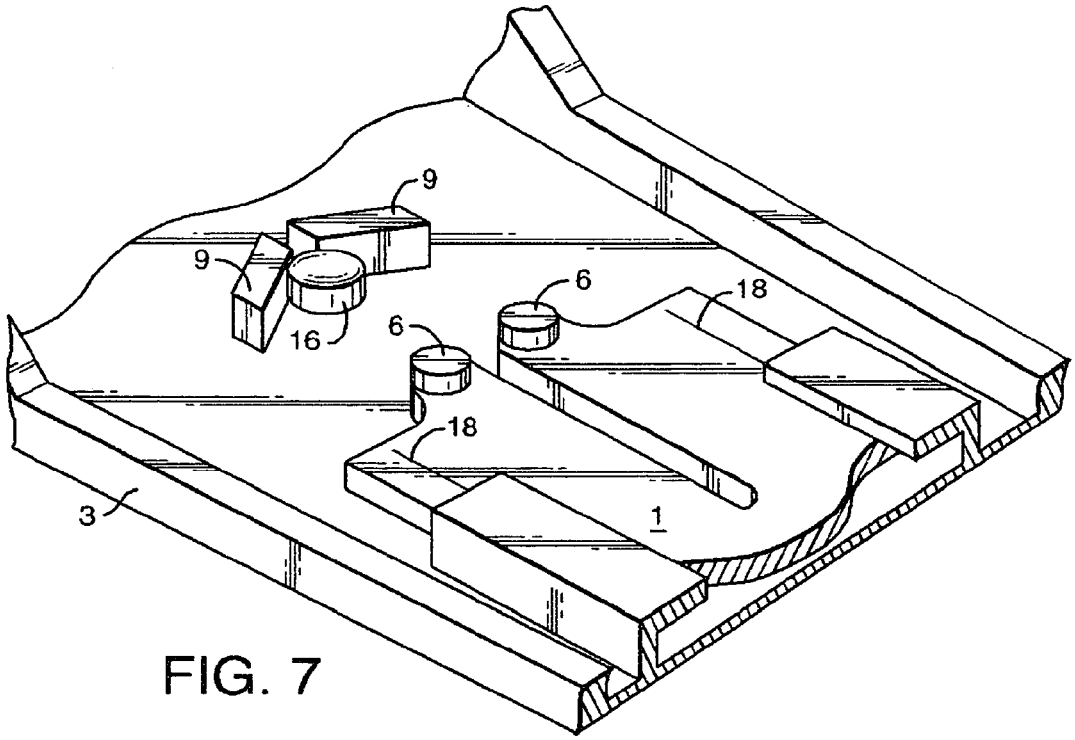
FIG. 7 depicts a perspective view of the portion of the lower body of the pill splitter in proximity to the upper stops, with a pill set against the upper stops, and with the slide partially withdrawn.

The operation of the pill splitter may be seen by referring now to FIGS. 7 and 8. Beginning with FIG. 1, a pill has been disposed against the pill stops, with the slide 1 withdrawn sufficiently to allow ease of handling of the pill within the pill splitter. This figure further shows the manner in which the slide mates with the slide guides, providing a secure means for guiding the slide 5 forward and backward, while maintaining its alignment parallel to the sides of the lower body 3.

In FIG. 3, the user has next pushed the slide forward so that the pill guides 6 are pushed against the pill. At the forward edge of the pill guides, where they meet with the pill, the pill guides are affixed over circular portions of the slide which conform exactly to the shape of the pill guides above. As a result, the forward edge of the slides and the pill guides do not present any discontinuities where they meet the pill, minimizing the likelihood of breaking or chipping the pill.

Still referring to FIGS. 7 and 8, it is seen that the space between the two pill stops is approximately equal to the width of the slot 7, where the cutting blade descends when the pill 16 is split.

Figure 5:
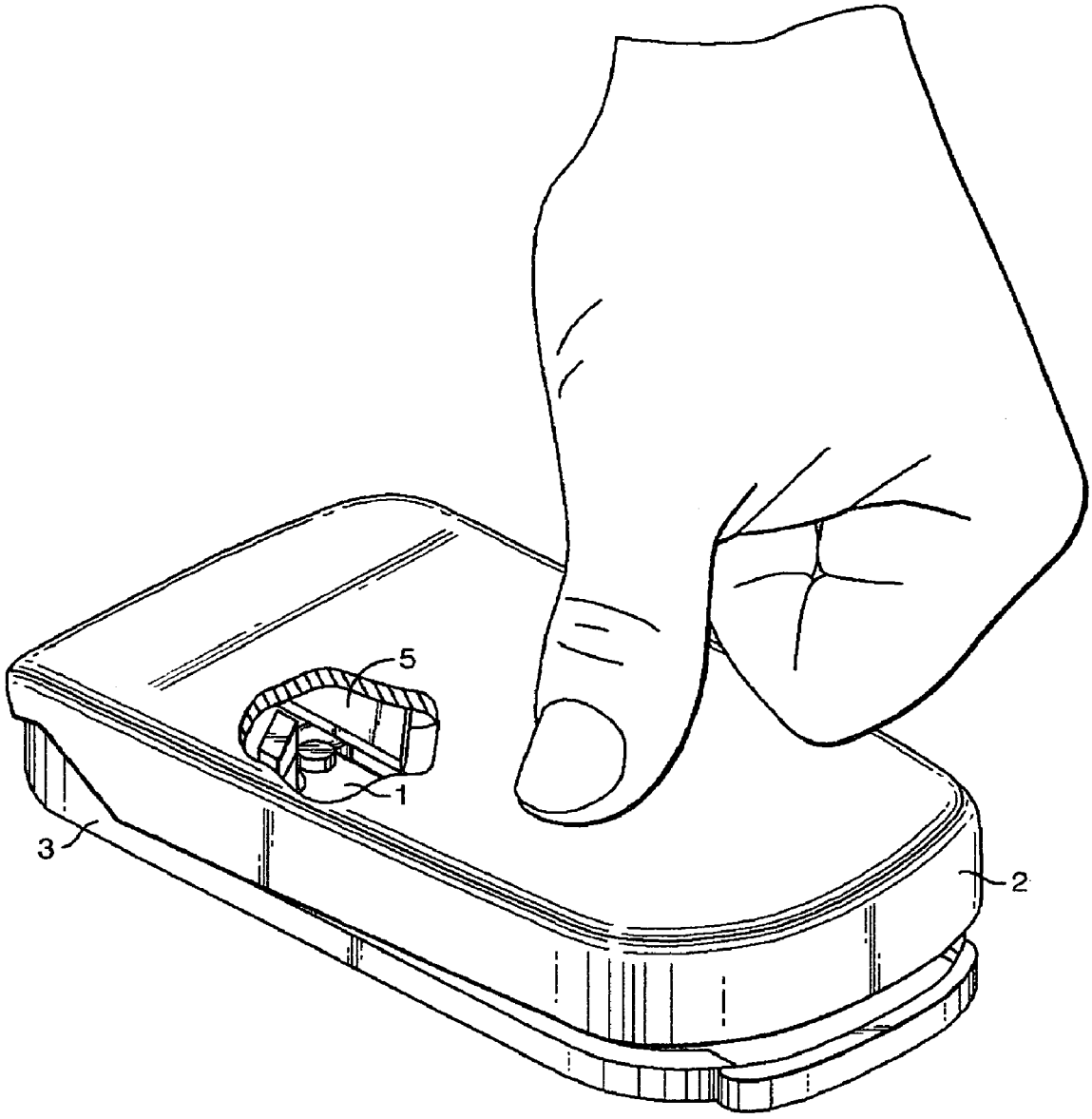
FIG. 5 depicts a perspective view of the pill splitter, with the upper body pushed down against the lower body, and with a pill being split within, as revealed in a cut-away view of the area in proximity to the pill splitter.

The actual splitting of the pill may be seen in FIG. 5, where the upper body has been rotated down, and pressed against the lower body after the pill has been put in place, as described above. The cutting blade 5 is now disposed directly above the pill, which has been affixed in place as shown in FIG. 8. The blade 5 is seen descending into the slot, and further into the space between the two pill stops. The handle 8 is almost all the way forward in the lower body, but is not permitted to enter all the way into the lower body because of the presence of the pill. When a pill is not present, the handle 8 will align perfectly with the lower body, and provide the appearance of a continuous surface.

It may be seen by referring to the above-reference drawings that this device will easily handle pills of many different sizes and shapes. Furthermore, it can also be used for cutting pills into quarters.

Figure 6:
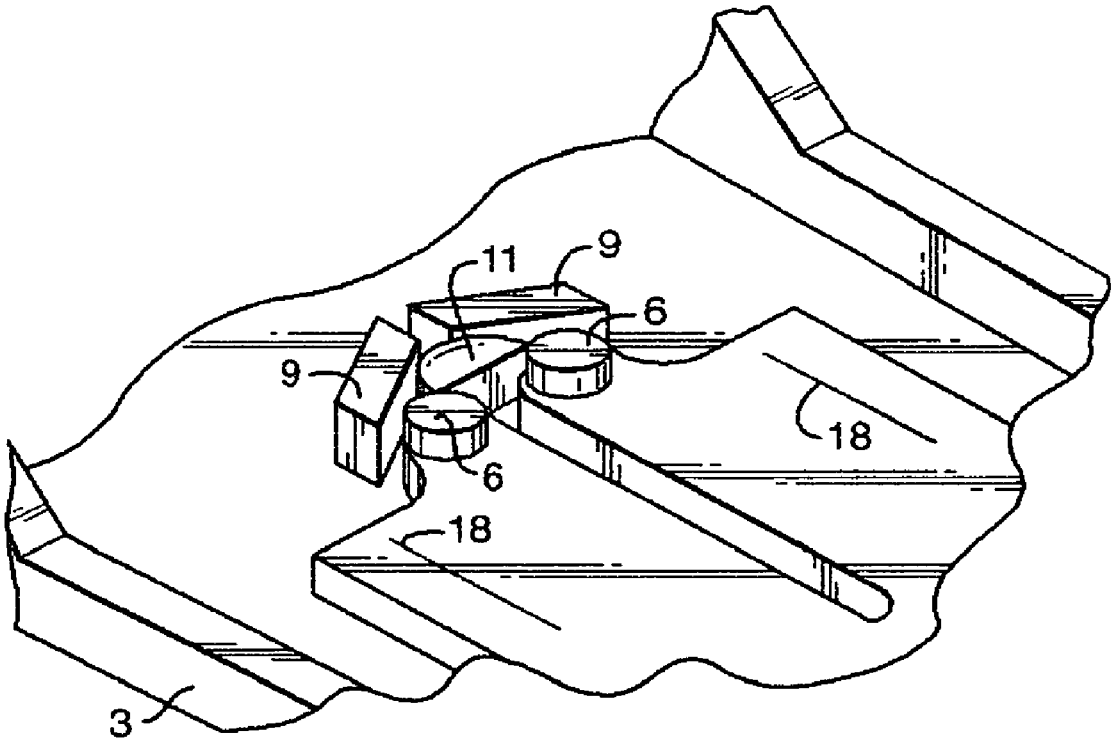
FIG. 6 depicts a perspective view of the portion of the lower body of the pill splitter in proximity to the upper stops, with a pill half securely retained between the upper stops and the pill guides.

The quartering process is accomplished by first cutting a pill in two pieces, by following the steps described above. Once the pill has been halved, one half is removed, and the other half 11 is placed with the rounded edge in contact with the pill stops, as shown in FIG. 6. The pill guides, formed on the forward edge of the slide, may now be advanced so that it comes into contact with the flat side of the pill, where is has just been split in two. FIG. 6 shows how the pill guides retain the flat edge of the half pill with equal facility as with the rounded edge of whole pill. Pressing the upper body down against the lower body now splits the half pill into two quarter pills, which are removed from the pill splitter. The other half pill is placed in the pill splitter, as described above, and the process in repeated, producing the remaining two pill quarters.

Because of the configuration of this pill splitter, it is easily and securely transported in a user's pocket or purse. Detents can easily be formed in the bodies, so that once closed entirely, the pill splitter will not accidentally open unless the user wishes to do so. Other types of safety catches or latches can easily be formed in the body, or attached thereto, accomplishing the same purpose as the detents.

The pill splitter relies for its universality on the ability to center pills on the cutting surface of the lower body, and firmly retain the pills in the centered position. The centering mechanism in the preferred embodiments relies on the pill tops, on one end of the lower body, and the pill guides, on the slides, which are configured so that the pills will be centered, as to the sides of the device. This centering mechanism works quite effectively when the radius of curvature of the pills is small in comparison to the space between the pill guides 6, and to the incline of the pill stops. When the radius of curvature of the pill is larger, however, the pill guides will no longer have the centering effect as for small, round pills. If the pill is flat on the side which engages the pill guides, for instance, the pill guides will have no centering effect at all.

In this eventuality, the user must attempt to center the pill manually, and uses the rulings 20 on the inside of the lower body, as shown in FIG. 3, and the slide rulings 18, as shown in FIG. 1. These rulings allow the user to visually center the pill between the pill stops and pill guides.

Besides its other virtues, this pill splitter is also easy to use, and requires only a slight pressure of the thumb on the outside surface of the upper body. It does not require a forceful blow with the palm of the hand, as do some existing pill splitters, and is suitable for the infirm and elderly, as well as for nurses who may split a large quantity of pills every day.

It will be apparent that improvements and modifications may be made within the purview of the device without departing from the scope of the device defined in the appended claims.

The invention claimed is:

1. A method for splitting pills, comprising the steps of:

a) forming a planar lower body;

b) centering the forward and rear sides of a pill on the lower body by:

i. forming a rigid, substantially v-shaped pill stop on the lower body;

ii. affixing two or more slide guides to the lower body;

iii. disposing a planar slide on the lower body, wherein a rear pill stop is formed on a forward end of said slide, said slide slideably guided by the slide guides, with the plane of the lower body parallel to the plane of the slide;

iv. advancing the slide until the rear pill stop is in contact with the rear side of the pill, so that the pill is retained securely between the pill stops;

wherein the rear stop comprises two or more pill guides affixed to the forward edge of the slide; and the method further comprising the step of forming a slot in the slide parallel to the sliding direction of the slide, and between the pill guides, with the slot exiting the forward edge so that a cutting blade can move through the slot while splitting the pill, and c) splitting the pill.

2. The method of claim 1, said step of splitting the pill further comprising forcing a cutting blade against a top of the pill.

3. The method of claim 2, comprising the further steps of:

(a) rotatingly affixing an upper body to the lower body;

(b) affixing the cutting blade to the upper body; and (c) rotating the upper body downward toward the lower body, forcing the cutting blade onto the top of the pill thereby.

4. The method of claim 3, wherein the pill guides are cylindrical in form.

5. The method of claim 4, wherein the pill guides extend beyond the forward edge of the slide.

6. The method of clam 5, further comprising a handle attached to a rear edge of the slide.

7. The method of claim 6, wherein the forward pill stop comprises a left forward stop and a right forward stop, with a space between them, the two stops forming a "V" shape with the open end of the "V" facing the forward edge of the slide.

8. The method of claim 7, further comprising disposing a finger guard at the rear end of the cutting blade, so that when the cutting blade descends the finger guard prevents the user from inserting his or her fingers in proximity to the cutting blade.

* * * * *